US010553334B2

(12) United States Patent
Yang et al.

(10) Patent No.: US 10,553,334 B2
(45) Date of Patent: Feb. 4, 2020

(54) FLAT CABLE

(71) Applicant: FOXCONN INTERCONNECT TECHNOLOGY LIMITED, Grand Cayman (KY)

(72) Inventors: A-Nan Yang, Huaian (CN); Han-Run Xie, Huaian (CN); Lu-Yu Chang, New Taipei (TW)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 16/111,252

(22) Filed: Aug. 24, 2018

(65) Prior Publication Data

US 2019/0066875 A1 Feb. 28, 2019

(30) Foreign Application Priority Data

Aug. 25, 2017 (CN) ..... 2017 2 1079114 U

(51) Int. Cl.

| | |
|---|---|
| ***H01B 7/00*** | (2006.01) |
| ***H01B 11/20*** | (2006.01) |
| ***H01B 7/08*** | (2006.01) |
| ***H01B 11/10*** | (2006.01) |
| ***H01B 11/00*** | (2006.01) |

(52) U.S. Cl.

CPC ..... *H01B 11/203* (2013.01); *H01B 7/0807* (2013.01); *H01B 7/0823* (2013.01); *H01B 11/002* (2013.01); *H01B 11/1033* (2013.01)

(58) Field of Classification Search

CPC ..... H01B 7/02

USPC ..... 174/110 R, 113, 117 R, 117 F, 117 FF

See application file for complete search history.

(56) References Cited

U.S. PATENT DOCUMENTS

| | | | | |
|---|---|---|---|---|
| 6,403,887 | B1 * | 6/2002 | Kebabjian | H01B 11/002 174/110 R |
| 6,630,624 | B2 * | 10/2003 | Tsao | H01B 7/0861 174/113 R |
| 6,765,150 | B2 * | 7/2004 | Hsieh | H01B 7/0861 174/117 F |
| 6,803,518 | B2 * | 10/2004 | Chang | H01B 11/002 174/113 R |
| 8,378,217 | B2 * | 2/2013 | Sugiyama | H01B 11/203 174/113 R |
| 9,697,926 | B2 * | 7/2017 | Huang | H01B 7/0823 |
| 2009/0104813 | A1 * | 4/2009 | Chen | H01R 9/038 439/581 |
| 2010/0206610 | A1 * | 8/2010 | Yagi | H01B 7/04 174/106 R |

(Continued)

FOREIGN PATENT DOCUMENTS

| | | | | |
|---|---|---|---|---|
| CN | 204632368 A | * | 9/2015 | H01B 7/08 |
| CN | 106450827 A | | 2/2017 | |

*Primary Examiner* — William H. Mayo, III

(74) *Attorney, Agent, or Firm* — Wei Te Chung; Ming Chieh Chang

(57) ABSTRACT

A flat cable (100) includes plural wires (10), an insulative layer (20) enclosing the wires, a metal shielding layer (30) enclosing the insulative layer, and a jacket (40) enclosing the metal shielding layer. The wires include plural pairs of differential wires (11) for transmitting high speed signals. The pairs of differential wires are evenly arranged in two rows, and each pair of differential wires is axially symmetrically arranged in the up and down direction.

16 Claims, 2 Drawing Sheets

(56) References Cited

U.S. PATENT DOCUMENTS

| | | | | |
|---|---|---|---|---|
| 2012/0111602 | A1* | 5/2012 | Wei | H01B 7/0861<br>174/114 R |
| 2017/0103830 | A1* | 4/2017 | Dettmer | H01B 11/002 |
| 2017/0110221 | A1* | 4/2017 | Wu | H01B 11/08 |

* cited by examiner

FLAT CABLE

BACKGROUND OF THE INVENTION

1. Field of the Invention

The present invention relates to a flat cable, and more particularly to an arrangement of the wires of the flat cable.

2. Description of Related Arts

U.S. Patent Application Publication No. 20170110221 discloses a round cable for transmitting high speed signal comprising a plurality of wires and a jacket enclosing the wires. The wires comprise a four pairs of differential wires for transmitting high speed signals and uniform distribution on a periphery of the round cable. The round cable needs to be arranged the differential wires in the position before being twisted, and finally covered with the jacket is not easy to maintain a relative position of the differential wires during twisting. It may affect the high speed differential signal transmission in the differential wires, and affect the electrical stability of the entire round cable. Moreover, the thickness of the round cable is thicker, occupying a large space, and has the disadvantages of difficult processing in the early stage and complicated processing steps.

Hence, an improved flat cable is desired to offer advantages over the related art.

SUMMARY OF THE INVENTION

An object of the present invention is to provide a flat cable having stable electrical performance.

To achieve the above-mentioned object, a flat cable comprises a plurality of wires including a plurality pairs of differential wires for transmitting high speed signals; an insulative layer enclosing the wires; a metal shielding layer enclosing the insulative layer; and a jacket enclosing the metal shielding layer; wherein the pairs of differential wires are evenly arranged in two rows, and each pair of differential wires is axially symmetrically arranged in the up and down direction.

According to the present invention, the pairs of differential wires are evenly arranged in two rows, and each pair of differential wires is axially symmetrically arranged in the up and down direction. Therefore, each pair of differential signal wires is easier to fix and maintain positional relationship with respect to each other during forming the insulative layer and the metal shielding layer.

DETAILED DESCRIPTION OF THE PREFERRED EMBODIMENT

Reference will now be made in detail to a preferred embodiment of the present invention.

Figure 1:
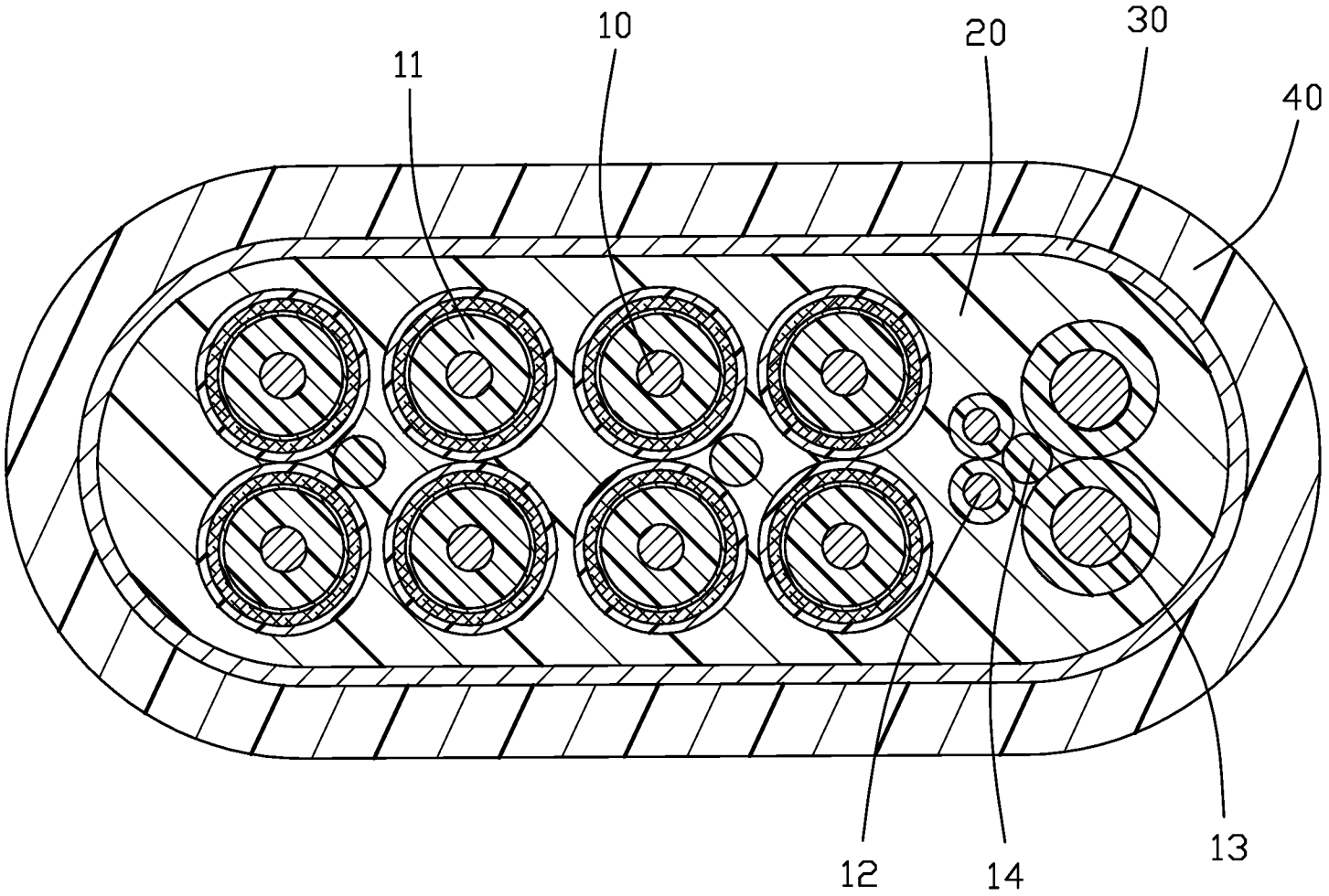
FIG. 1 is a cross-sectional view of a flat cable in accordance with present invention.
Figure 2:
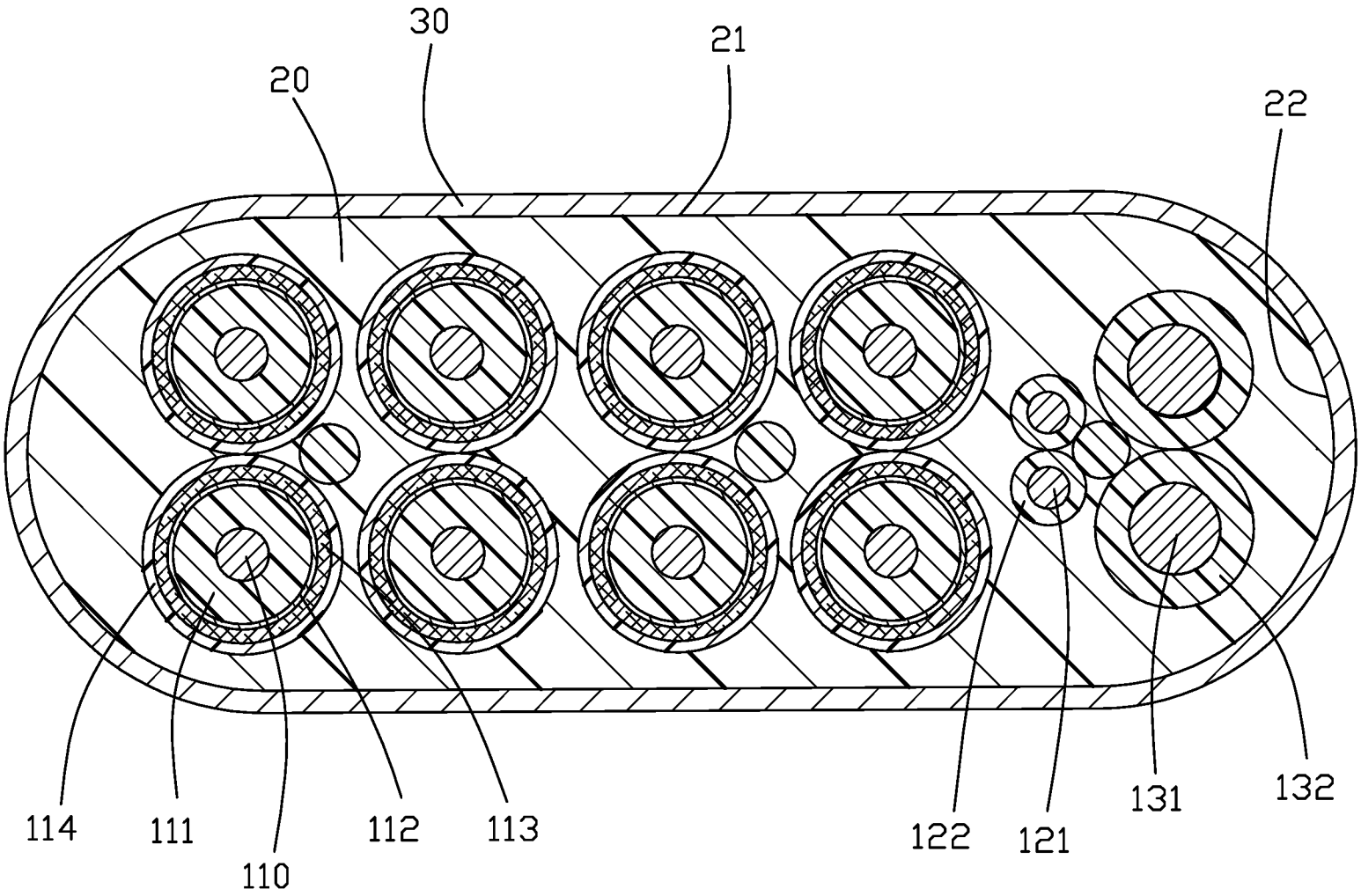
FIG. 2 is a part of cross-sectional view of a flat cable as shown in FIG. 1.

Referring to FIGS. 1 and 2, a flat cable 100 comprises a plurality of wires 10, an insulative layer 20 enclosing the wires 10, a metal shielding layer 30 enclosing the insulative layer 20, and a jacket 40 enclosing the metal shielding layer 30. In this embodiment, the insulative layer 20 is filled enclosing the wires 10. The metal shielding layer 30 is made of metal braid. The flat cable 100 is used to transmitting USB C type signal.

The wires 10 comprises a plurality pairs of differential wires 11 for transmitting high speed signals, a pair of control wires 12 for transmitting control signals, a pair of power wires 13 for transmitting power, and a plurality of fiber wires 14, for reinforcement, disposed in the insulative layer 20.

All of the differential wires 11 are coaxial wire. Each of the differential wires 11 comprises a central conductor 110, an inner insulative layer 111 enclosing the central conductor 110, a copper foil layer 112 enclosing the inner insulative layer 111, a metal braid layer 113 enclosing the copper foil layer 112, and an outer insulative layer 114 enclosing the metal braid layer 113. The pairs of differential wires 11 are evenly arranged in two rows, and each pair of differential wires 11 is axially symmetrically arranged in the up and down direction. Each pair of differential wires 11 abuts each other in the up and down direction. Two adjacent pairs of differential wires 11 are spaced apart from each other along a horizontal direction perpendicular to the up and down direction. In this embodiment, there are four pairs of differential wires 11 for transmitting four pairs of high speed differential signals. The jacket is made of PET (Polyethylene terephthalate). Therefore, each pair of differential wires 11 is more easily fixed and maintains a positional relationship with each other when the insulating layer 20 and the metal shielding layer 30 are formed, so that the flat cable 100 of the present invention has a stable electrical performance. In this embodiment, every four differential wires 11 are grouped in a 2×2 matrix.

The pair of control wires 12 are disposed between and spaced apart from the differential wires 11 and the power wires 13 in the horizontal direction. The pair of control wires 12 are axially symmetrically arranged in the up and down direction and abut each other. Both of the control wires 12 comprise an inner conductor 121 and an insulative portion 122 enclosing the inner conductor 121. Each of the differential wires 11 has an outer diameter greater than an outer diameter of each of the control wires 12.

The pair of power cable 13 disposed on and spaced apart from one side of the horizontal direction of the differential wires 11. The pair of power wires 13 are axially symmetrically arranged in the up and down direction and abut each other. Both of the power cable 13 comprise an inner conductor 131, and an insulative portion 132 enclosing the inner conductor. The outer diameter of each of the differential wires 11 is greater than an outer diameter of each of the power wires 13. The outer diameter of each of the power wires 13 is greater than an outer diameter of each of the control wire 12. It should be noted that in other embodiments, the outer diameter of the differential wires 11 and the outer diameter of the power wires 13 can be adjusted according to actual use requirements such as the length, current, and voltage drop of use of the flat cable 100.

The fiber wires 14 are disposed among the differential wires 11, the control wires 12 and the power wires 13. In this embodiment, the fiber wires 14 are arranged on a symmetrical center line extending in the horizontal direction of the flat cable 100. Specifically, there are three fiber wires 14. One of the fiber wires 14 is located between two adjacent pairs of differential wires 11. Another of the fiber wires 14 is located between the other two adjacent pairs of differential wires 11. In other words, the fiber wire 14 is essentially located around a center region of the aforementioned four differential wires which are arranged in a 2×2 matrix. Another of the fiber wires 14 is sandwiched between the control wires 12 and the power wires 13. The fiber wires 14 can enhance the bending resistance of the flat cable 100, thereby increasing the strength of the flat cable 100.

The flat cable 100 of the present invention is formed, the differential wires 11, the control wires 12, the power wires 13 and the fiber wires 14 are first arranged in a jig, secondly, squeezing the insulative layer 20 over the periphery of the wire 10 and formed the inner insulating layer 20 having flat cross section, then, fixed the insulating layer 20 and formed the metal shielding layer 30 on the periphery of the insulating layer 20, finally, squeezing the jacket 40 to enclose the periphery of the metal shielding layer 30.

The cross section of the insulating layer 20 of the flat cable 100 comprises two mutually parallel horizontal edges 21 extending along the horizontal direction and two curved edge 22 the two horizontal edges 21, respectively. The thickness of the metal shielding layer 30 and the jacket 40 in the radial direction is uniform. A thickness of the jacket 40 in the radial direction is greater than a thickness of the metal shielding layer 30 in the radial direction.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A flat cable comprising:

a plurality of wires including plural pairs of differential wires for transmitting high speed signals;

an insulative layer enclosing the wires;

a metal shielding layer enclosing the insulative layer; and a jacket enclosing the metal shielding layer; wherein the pairs of differential wires are evenly arranged in two rows in a horizontal direction, and the two wires of each pair of differential wires are axially symmetrically arranged in an up and down direction perpendicular to the horizontal direction.

2. The flat cable as recited in claim 1, wherein each of the differential wires comprises a central conductor, an inner insulative layer enclosing the central conductor, a copper foil layer, a metal braid layer enclosing the copper foil layer, and an outer insulative layer enclosing the metal braid layer.

3. The flat cable as recited in claim 1, wherein each pair of differential wires abuts each other in the up and down direction.

4. The flat cable as recited in claim 3, wherein two adjacent pairs of differential wires are spaced apart from each other.

5. The flat cable as recited in claim 1, wherein the insulative layer is fillingly enclosing the wires.

6. The flat cable as recited in claim 1, wherein the plurality of wires comprises a pair of power wires for transmitting power, the power wires disposed on one side of the differential wires, the pair of power wires axially symmetrically arranged in the up and down direction and abut each other.

7. The flat cable as recited in claim 6, wherein the plurality of wires comprises a pair of control wires for transmitting control signals, the control wires disposed between the differential wires and the power wires in the horizontal direction, the pair of control wires axially symmetrically arranged in the up and down direction and abut each other.

8. The flat cable as recited in claim 7, wherein each of the differential wires has an outer diameter greater than an outer diameter of each of the power wires and the control wires, the outer diameter of each of the power wires being greater than the outer diameter of each of the control wires.

9. The flat cable as recited in claim 1, wherein the plurality of wires comprises a fiber wire disposed in the insulative layer.

10. The flat cable as recited in claim 9, wherein the fiber wire is arranged on a symmetrical center line extending in the horizontal direction of the flat cable.

11. A flat cable comprising:

a plurality of wires including plural pairs of differential wires for transmitting high speed signals;

an insulative layer enclosing the wires;

a metal shielding layer enclosing the insulative layer; and a jacket enclosing the metal shielding layer; wherein the pairs of differential wires are divided into two groups each having two pairs of the differential wires and closely arranged in a 2×2 matrix with a reinforcement fiber wire around a center thereof; and in each group, two neighboring wires in a transverse direction are spaced apart from each other while two neighboring wires in a vertical direction perpendicular to the transverse direction abut each other.

12. The flat cable as claimed in claim 11, wherein each wire of said differential wires includes a center conductor, an inner insulative layer, a copper foil layer, a metal braid layer and an outer insulative layer coaxially arranged with one another in sequence.

13. The flat cable as claimed in claim 11, further including a pair of control wires and a pair of power wires densely arranged together with another reinforcement fiber around a center region thereof by one side of said plural pairs of differential wires in a transverse direction.

14. A flat cable comprising:

a plurality of wires including plural pairs of differential wires for transmitting high speed signals;

an insulative layer enclosing the wires;

a metal shielding layer enclosing the insulative layer; and a jacket enclosing the metal shielding layer; wherein the pairs of differential wires are divided into two groups each having two pairs of the differential wires and closely arranged in a 2×2 matrix with an insulative reinforcement fiber wire around a center of said 2×2 matrix; wherein each wire of said differential wires includes at least a center conductor, an inner insulative layer, and one of a copper foil layer and a metal braid layer in sequence; wherein said insulative reinforcement fiber is diametrically smaller than each of said differential wires.

15. The flat cable as claimed in claim 14, further including a pair of power wires and a pair of control wires densely arranged together with another insulative reinforcement fiber located around a center thereof and commonly enclosed in said insulative layer.

16. The flat cable as claimed in claim 15, wherein the pair of power wires and the pair of control wires with the corresponding reinforcement fiber are located by one side of all the plural pairs of the differential wires.

* * * * *